US006802948B2

(12) United States Patent
Hardee et al.

(10) Patent No.: US 6,802,948 B2
(45) Date of Patent: Oct. 12, 2004

(54) COPPER ELECTROWINNING

(75) Inventors: Kenneth L. Hardee, Middlefield, OH (US); Lynne M. Ernes, Willoughby, OH (US); Carl W. Brown, Jr., Leroy Township, OH (US)

(73) Assignee: Eltech Systems Corporation, Chardon, OH (US)

( * ) Notice: Subject to any disclaimer, the term of this patent is extended or adjusted under 35 U.S.C. 154(b) by 168 days.

(21) Appl. No.: 10/194,127

(22) Filed: Jan. 30, 2002

(65) Prior Publication Data

US 2003/0019760 A1 Jan. 30, 2003

Related U.S. Application Data

(60) Division of application No. 09/648,506, filed on Aug. 25, 2000, now Pat. No. 6,368,489, which is a continuation-in-part of application No. 09/273,981, filed on Mar. 22, 1999, now Pat. No. 6,139,705.

(60) Provisional application No. 60/084,396, filed on May 6, 1998.

(51) Int. Cl.[7] ..... C25B 11/00

(52) U.S. Cl. ..... 204/290.14; 204/290.01; 204/290.09

(58) Field of Search ..... 204/280, 290.01, 204/290.08, 290.09, 290.14

(56) References Cited

U.S. PATENT DOCUMENTS

| | | | | | |
|---|---|---|---|---|---|
| 3,880,733 | A | * | 4/1975 | Eggett et al. | 205/578 |
| 4,707,229 | A | * | 11/1987 | Dempsey et al. | 205/636 |
| 4,765,874 | A | | 8/1988 | Modes et al. | |
| 6,139,705 | A | * | 10/2000 | Brown et al. | 204/284 |
| 6,217,729 | B1 | * | 4/2001 | Zolotarsky et al. | 204/290.08 |

FOREIGN PATENT DOCUMENTS

| | | |
|---|---|---|
| EP | 0 892 086 | 7/1998 |
| WO | WO 99 57338 | 11/1999 |

* cited by examiner

*Primary Examiner*—Bruce F. Bell
(74) *Attorney, Agent, or Firm*—Michele M. Tyrpak; Hudak, Shunk & Farine Co, LPA

(57) ABSTRACT

There is disclosed a method for cooper electrowinning and a modified lead electrode for use in such method. The modified electrode is suitable for use as an oxygen anode in low current density, oxygen-evolving applications.

25 Claims, No Drawings

COPPER ELECTROWINNING

CROSS REFERENCE

This is a divisional application of Ser. No. 09/648,506 filed on Aug. 25, 2000 of Kenneth Hardee, for COPPER ELECTROWINNINGS, now U.S. Pat. No. 6,368,489, which is a continuation in part of Ser. No. 09/273,981 filed Mar. 22, 1999 now application U.S. Pat. No. 6,139,705, which claims the benefit of U.S. Provisional Application 60/084,396, filed May 6, 1998.

BACKGROUND OF THE INVENTION

1. Field of the Invention

The invention is directed to copper electrowinning, which is a low current density, oxygen evolving application. The copper can be electrowon utilizing a modified lead electrode. The modified electrode is suitable for use as an oxygen anode in copper electrowinning.

2. Description of the Related Art

Lead or lead alloy anodes have been widely employed in processes for the electrowinning of metals, such as copper, from sulphate electrolytes. These lead anodes, nevertheless, have important limitations such as undesirable power consumption and anode erosion. This anode erosion can lead to sludge production and resulting contamination of electrolyte, as well as contamination of the plated product, e.g., lead contamination of a copper plated product.

Therefore, it was proposed to make a composite anode from a sintered article of one metal, e.g., titanium, which article is infiltrated with the other metal, e.g., lead. These anodes have been proposed, for example, in U.S. Pat. No. 4,260,470. The titanium can be ground, compressed and sintered to prepare a titanium sponge as a porous matrix. This matrix is then infiltrated with molten lead or lead alloy. The object is first to provide planar anodes in the form of strips. The strips are then joined together in a parallel, co-planar array to provide a large sheet anode. The patent teaches employing these anodes particularly for use in electrowinning zinc or copper from sulfate electrolytes.

It has also been proposed to prepare catalytic particles of a metal such as titanium, which particles are activated with a platinum group metal. These particles are then uniformly distributed over, and partly embedded within, the surface of an anode base of lead or lead alloy. The lead plate is thus covered with a layer of these particles, such as of activated titanium sponge particles. Such an anode has been disclosed in U.S. Pat. No. 4,425,217.

It has also been proposed to use a lead substrate as a support structure. This support structure provides a surface that may engage another member, e.g., a valve metal expanded metal mesh. As disclosed in U.S. patent application Ser. No. 09/273,981, the mesh member has a front and back surface with the back surface facing the lead support structure. At least the front surface of the mesh member is an active surface. Securing of the mesh member to the lead support structure in electrical connection permits the lead support structure to serve as a current distributor for the mesh member. The mesh member may engage the surface of the lead support structure as by pressing or rolling the mesh onto the lead.

It would, however, be desirable to provide an electrode for such service having improved lifetimes and provide voltage savings without this being offset by a prohibitive cost due either to a high cost of the electrode materials or a high production cost or a combination of these.

SUMMARY OF THE INVENTION

There has now been found an electrode, which provides improved lifetimes and voltage savings, both of which may be coupled with enhanced current efficiency during cell operation, while remaining cost effective. The electrode is especially beneficial to the electrowinning industry by providing significant voltage savings compared with conventional lead anodes, substantial elimination of sludge formation resulting in less downtime for cleaning of cells and fewer environmental disposal problems. Additionally, the purity of the plated product is improved.

In one aspect, the invention is directed to a process for electrowinning copper from a solution in an electrolytic cell comprising at least one anode, with there being oxygen evolution and cell voltage savings during said electrowinning, which process comprises:

providing an unseparated electrolytic cell;

establishing in the cell a sulfate electrolyte containing the copper metal in solution;

providing an anode in the cell in contact with the electrolyte which anode has a lead base and a mesh surface member, which mesh surface member has a broad, coated front face and a broad back face that faces the lead base, with the coated front face having an electrocatalytic coating consisting of palladium oxide and ruthenium oxide constituents in a proportion of from at least about 50 mole percent up to about 99 mole percent ruthenium and at least about 1 mole percent palladium up to about 50 mole percent palladium basis 100 mole percent of these metals present in the coating;

impressing an electric current on the anode; and conducting the electrowinning at an applied current density of below about 1 $kA/m^2$.

In another aspect, the invention is directed to a process for electrowinning copper from a solution in an electrolytic cell comprising at least one anode, with there being oxygen evolution and cell voltage savings during said electrowinning, which process comprises:

providing an unseparated electrolytic cell;

establishing in the cell a sulfate electrolyte containing the copper metal in solution;

providing an anode in the cell in contact with the electrolyte which anode has a lead base and a metal mesh surface member, which metal mesh surface member has a broad, coated front face and a broad back face that faces the lead base, with the coated front face having an electrocatalytic coating consisting of rhodium oxide and ruthenium oxide constituents in a proportion providing from at least about 0.5 mole percent up to about 50 mole percent rhodium and at least about 50 mole percent up to about 99.5 mole percent ruthenium basis 100 mole percent of these metals present in the coating;

impressing an electric current on the anode; and conducting the electrowinning at an applied current density of below about 1 $kA/m^2$.

In yet another aspect, the invention is directed to a process for electrowinning a metal from a solution in an electrolytic cell comprising at least one anode, with there being oxygen evolution and cell voltage savings during said electrowinning, which process comprises:

providing an unseparated electrolytic cell;

establishing in the cell an electrolyte containing the metal in solution;

providing an anode in cell in contact with said electrolyte which anode has a lead base and a mesh surface member, which mesh surface member has a broad, coated front face and a broad back face that faces the lead base, with the coated front face having an electrocatalytic coating consisting of constituents in a proportion of from at least about 50 mole percent up to about 99 mole percent ruthenium and at least about 1 mole percent palladium up to about 50 mole percent palladium, basis 100 mole percent of these metals present in the coating;

impressing an electric current on the anode; and conducting the electrowinning at an applied current density of below about 1 $kA/m^2$.

In a still further aspect, the invention is directed to a process for electrowinning a metal from a solution in an electrolytic cell comprising at least one anode, with there being oxygen evolution and cell voltage savings during the electrowinning, which process comprises:

providing an unseparated electrolytic cell establishing in the cell an electrolyte containing the metal in solution;

providing an anode in the cell in contact with the electrolyte which anode has a lead base and a metal mesh surface member, which metal mesh surface member has a broad, coated front face and a broad back face that faces the lead base, with the coated front face having an electrocatalytic coating consisting of rhodium oxide and ruthenium oxide constituents in a proportion providing from at least about 50 mole percent up to about 99.5 mole percent ruthenium and at least about 0.5 mole percent rhodium up to about 50 mole percent rhodium, basis 100 mole percent of these metals present in the coating;

impressing an electric current on the anode; and conducting the electrowinning at an applied current density of below about 1 $kA/m^2$.

In a still further aspect, the invention is directed to an electrode for use in a low current density, oxygen evolving application with a sulfate electrolyte, the electrode comprising:

(a) a solid lead electrode base;

(b) a valve metal surface combined with the lead base in electrically conductive contact; and (c) a coating layer of an electrochemically active coating on the valve metal surface member, the coating comprising a mixture of platinum group metal oxides consisting essentially of ruthenium oxide and palladium oxide or ruthenium oxide and rhodium oxide, wherein the ruthenium oxide and palladium oxide or ruthenium oxide and rhodium oxide are present in a molar proportion of from about 50:50 to about 99:1 of ruthenium to palladium or ruthenium to rhodium, as metals.

In yet another aspect, the invention is directed to a multilayered electrode for use in an electrochemical cell, the multilayered electrode comprising a substrate member of lead or lead alloy and a valve metal member combined with the lead electrode base, which lead base is in sheet form and has a large broad surface, and which valve metal member is in electrically conductive contact with the lead base which valve metal member is in mesh form and has a front, coated major face and a back major face, with the back major face of the valve metal member facing the lead base, said front coated major face having at least one coating layer of an electrochemically active coating comprising a mixture of platinum group metal oxides consisting essentially of ruthenium oxide and palladium oxide, wherein the ruthenium oxide and palladium oxide are present in a molar proportion of from about 50:50 to about 99:1 of ruthenium to palladium, as metals, and wherein the valve metal member is combined with the lead base in electrical contact, while the valve metal member at the broad surface projects a coated face from the lead base and presents an active surface in mesh form for the multilayered electrode.

In a final aspect, the invention is directed to a method of producing an electrode for use in a low current density, oxygen evolving electrolytic cell, the method comprising the steps of:

establishing a valve metal substrate;

preparing a surface of the valve metal substrate;

providing at least one coating layer of an electrochemically active coating comprising a mixture of platinum group metal oxides consisting essentially of ruthenium oxide and palladium oxide, wherein the ruthenium oxide and palladium oxide are present in a molar proportion of from about 50:50 to about 99:1 of ruthenium to palladium, as metals; and heating the electrochemically active coating.

DESCRIPTION OF THE PREFERRED EMBODIMENTS

The electrolytic process of the present invention is particularly useful in the electrowinning of copper from a sulfate electrolyte. The electrode described herein when used in such an electrowinning process will virtually always find service as an anode. Thus, the word "anode" is often used herein when referring to the electrode, but this is simply for convenience and should not be construed as limiting the invention. Since the electrode will most always have a base and a mesh member, it is sometimes referred to herein for convenience as a "compound electrode" or the like, e.g., "compound anode", or as an "electrode structure".

When there is a support structure, or "base" for the electrode utilized in the invention process, it is contemplated to be a base of lead or alloys of lead, such as lead alloyed with tin, silver, antimony, calcium, strontium, indium or lithium. The lead base is usually in a flat sheet form and the sheet is virtually always a solid sheet. However, other forms are contemplated. Thus, for example, the lead base may have a cylindrical form or the like, such as elliptical. Still other forms of the lead base may include a perforate base and form a flow-through electrode. As a sheet form base, the sheet will usually have a thickness within the range of from about ⅛ inch to about 2 inches, but some lead base electrodes can have thickness of up to about 2 feet or more.

For the compound electrode utilized in the invention process, such electrode will advantageously have a mesh member, which may sometimes be simply referred to herein as the "mesh". In general, compound electrodes as are serviceable herein have been disclosed in U.S. patent application Ser. No. 09/273,981, the disclosure of which is incorporated herein by reference. The lead base can serve as a current distributor member for the mesh member. The metals for the mesh are broadly contemplated to be any coatable metal. For the particular application of an electrocatalytic coating, the mesh might be such as nickel or manganese, but will most always be valve metals, including titanium, tantalum, aluminum, zirconium and niobium. Of particular interest for its ruggedness, corrosion resistance and availability is titanium. As well as the normally available elemental metals themselves, the suitable metals of the substrate include metal alloys and intermetallic mixtures, as well as ceramics and cermets such as contain one or more valve metals. For example, titanium may be alloyed with nickel, cobalt, iron, manganese or copper. More specifically, grade 5 titanium may include up to 6.75 weight percent aluminum and 4.5 weight percent vanadium, grade 6 up to 6 percent aluminum and 3 percent tin, grade 7 up to 0.25 weight percent palladium, grade 10, from 10 to 13 weight percent plus 4.5 to 7.5 weight percent zirconium and so on.

By use of elemental metals, it is most particularly meant the metals in their normally available condition, i.e., having minor amounts of impurities. Thus, for the metal of particular interest, i.e., titanium, various grades of the metal are available including those in which other constituents may be alloys or alloys plus impurities. Grades of titanium have been more specifically set forth in the standard specifications for titanium detailed in ASTM B 265-79. Because it is a metal of particular interest, titanium will often be referred to herein for convenience when referring to metal for the metal mesh. The mesh member may be secured to the base by a multitude of fasteners. These can include brads, staples, split nails, rivets, studs, screws, bolts, spikes and the like.

It will be understood that there can be an exposed surface area of lead base provided by voids of the mesh, i.e., the mesh "void fraction" or mesh "open area". This may provide on the order of as little as about 5 or 10 percent, or up to 25 percent open area, up to a greatly expanded mesh, such as will provide from about 85 to about 90 percent exposure. Moreover, the top of a lead base, as well as other portions, e.g., edges of the base, may be left exposed, i.e., uncovered by the mesh. On the other hand, it will be appreciated that the mesh member may extend edge-to-edge, from either top-to-bottom or side-to-side edges, or both, which will typically be done by using a mesh in sheet form. It is also contemplated that the lead base may be wrapped with the mesh member as with a mesh member in strip form. In this regard, a wrap of a mesh member around a base for preparing an electrode has been disclosed in International Application WO/96/34996.

Furthermore, exposed surfaces for the base could be covered. Covering can be in the form of a coating. Such a coating can take many forms and can be generally applied by any manner for applying a coating substance to a metal substrate. For example, a protective coating can be applied in sheet form to an entire face of a lead base. Such sheet form protection might be a nonconductive polymeric sheet. The coating might further be exemplified by a wax, including paraffin. Or the protective coating might be provided by a curable liquid that is applied, and cured on, the lead base, e.g., a paint.

Where a lead base is a new lead base, it can have a freshly prepared area for securing of the mesh member to the lead base. Where the lead base has been previously utilized, at least such may be refurbished, or "prepared", e.g., to provide a fresh lead face. Such preparation may be by one or more of a mechanical operation such a machining, grinding and blasting, including one or more of sand, grit, and water blasting. There can also be utilized sanding and buffing. Preparation may also include a chemical procedure such as etching or current reversal. Such operations can form a suitably prepared surface for securing the mesh member thereto.

Regardless of the metal selected and the form of the mesh member, before applying a coating composition thereto, the metal mesh member surface is advantageously a cleaned surface. This may be obtained by any of the treatments used to achieve a clean metal surface, including mechanical cleaning. The usual cleaning procedures of degreasing, either chemical or electrolytic, or other chemical cleaning operation may also be used to advantage. Where the substrate preparation includes annealing, and the metal is grade 1 titanium, the titanium can be annealed at a temperature of at least about 450° C. for a time of at least about 15 minutes, but most often a more elevated annealing temperature, e.g., 600–875° C. is advantageous.

When a clean surface, or prepared and cleaned surface has been obtained, it may be advantageous to obtain a surface roughness. This will be achieved by means which include intergranular etching of the metal, plasma spray application, which spray application can be of particulate valve metal or of ceramic oxide particles, or both, and sharp grit blasting of the metal surface, followed by surface treatment to remove embedded grit.

Etching will be with a sufficiently active etch solution to develop aggressive grain boundary attack. Typical etch solutions are acid solutions. These can be provided by hydrochloric, sulfuric, perchloric, nitric, oxalic, tartaric, and phosphoric acids as well as mixtures thereof, e.g., aqua regia. Other etchants that may be utilized include caustic etchants such as a solution of potassium hydroxide/hydrogen peroxide, or a melt of potassium hydroxide with potassium nitrate. Following etching, the etched metal surface can then be subjected to rinsing and drying steps. The suitable preparation of the surface by etching has been more fully discussed in U.S. Pat. No. 5,167,788, which patent is incorporated herein by reference.

In plasma spraying for a suitably roughened metal surface, the material will be applied in particulate form such as droplets of molten metal. In this plasma spraying, such as it would apply to spraying of a metal, the metal is melted and sprayed in a plasma stream generated by heating with an electric arc to high temperatures in inert gas, such as argon or nitrogen, optionally containing a minor amount of hydrogen. It is to be understood by the use herein of the term "plasma spraying" that although plasma spraying is preferred the term is meant to include generally thermal spraying such as magnetohydrodynamic spraying, flame spraying and arc spraying, so that the spraying may simply be referred to as "melt spraying" or "thermal spraying".

The particulate metal employed may be a valve metal or oxides thereof, e.g., titanium oxide, tantalum oxide and niobium oxide. It is also contemplated to melt spray titanates, spinels, magnetite, tin oxide, lead oxide, manganese oxide and perovskites. It is also contemplated that the oxide being sprayed can be doped with various additives including dopants in ion form such as of niobium or tin or indium.

It is also contemplated that such plasma spray application may be used in combination with etching of the substrate metal surface. Or the mesh member may be first prepared by grit blasting, as discussed hereinabove, which may or may not be followed by etching.

It has also been found that a suitably roughened metal surface can be obtained by special grit blasting with sharp grit followed by removal of surface embedded grit. The grit, which will usually contain angular particles, will cut the metal surface as opposed to peening the surface. Serviceable grit for such purpose can include sand, aluminum oxide, steel and silicon carbide. Etching, or other treatment such as water blasting, following grit blasting can remove embedded grit.

It will be understood from the foregoing that the surface may then proceed through various operations, providing a pretreatment before coating, e.g., the above-described plasma spraying of a valve metal oxide coating. Other pretreatments may also be useful. For example, the surface may be subjected to a hydriding or nitriding treatment. Prior to coating with an electrochemically active material, it has been proposed to provide an oxide layer by heating the substrate in air or by anodic oxidation of the substrate as described in U.S. Pat. No. 3,234,110. Various proposals have also been made in which an outer layer of electrochemically active material is deposited on a sublayer, which primarily serves as a protective and conductive intermediate. Various tin oxide based underlayers are disclosed in U.S. Pat. Nos. 4,272,354, 3,882,002 and 3,950,240. It is also contemplated that the surface may be prepared as with an antipassivation layer.

Following surface preparation, which might include providing a pretreatment layer such as described above, an electrochemically active coating layer may then be applied to the substrate member. As is typically representative of the electrochemically active coatings that are often applied, are those provided from active oxide coatings such as platinum group metal oxides, magnetite, ferrite, cobalt spinel or mixed metal oxide coatings. They may be water based, such as aqueous solutions, or solvent based, e.g., using alcohol solvent. However, for the copper electrowinning process of the present invention, the coating of choice is ruthenium oxide and palladium oxide. The preferred coating composition solutions are typically those consisting of $RuCl_3$, $PdCl_2$ and hydrochloric acid, all in alcohol solution. It will be understood that the $RuCl_3$ may be utilized in a form such as $RuCl_3.H_2O$ and $PdCl_2$ can be similarly utilized. For convenience, such forms will generally be referred to herein simply as $RuCl_3$ and $PdCl_2$. Generally, the ruthenium chloride will be dissolved along with the palladium chloride in an alcohol such as either isopropanol or butanol, all combined with small additions of hydrochloric acid, with butanol being preferred.

Such coating composition will contain sufficient Pd constituent to provide at least about 1 mole percent up to about 50 mole percent palladium metal, basis 100 mole percent of palladium and ruthenium metals, with a preferred range being from about 5 mole percent up to about 25 mole percent palladium. A composition containing palladium in an amount less than about 1 mole percent will be inadequate for providing an electrode coating having a low operating voltage and extended service life. On the other hand, greater than about 50 mole percent palladium will also be detrimental to a low operating voltage and extended service life. As a balance, the coating will thus contain from about 50 mole percent to about 99 mole percent of ruthenium, and preferably from about 75 to about 95 mole percent of ruthenium. As will be understood from the foregoing, for best coating characteristics, the molar ratio of ruthenium to palladium, as metals, in the resulting coating will advantageously be from greater than 50:50 up to about 99:1, and preferably from about 75:25 to about 95:5.

It was unexpected that this coating for the present invention would provide extended lifetimes for copper electrowinning. It was appreciated that the coatings of palladium oxide and ruthenium oxide were generally not coatings of choice for chlorine and hypochlorite production. For example, it has been disclosed in Japanese patent application no. 51-56783 that a proposed coating of 55–95 mol % palladium oxide and 5–45 mol % ruthenium oxide provided a very poor lifetime. Because of this, such a coating led to attempts to remedy such poor lifetime performance as by establishing an underlayer coating or by contributing as much as 20–90 mol % titanium oxide to the coating of palladium oxide and ruthenium oxide. Such considerations have been discussed in U.S. Pat. No. 4,517,068 wherein there is disclosed an improved electrocatalyst wherein titanium oxide is combined with palladium oxide and ruthenium oxide. Furthermore, it has been considered to combine platinum with ruthenium to provide a gas-evolving catalytic anode. For such purpose it was necessary to use a reduced platinum-ruthenium oxide, as taught in U.S. Pat. No. 4,039,409. But for the present invention, the coating is a non-reduced oxide coating.

Moreover, for electrowinning anodes, it has previously been found useful to utilize the palladium for providing a layer by itself. It has been taught that there can be used a layer containing ruthenium oxide, but this is taught to be combined with titanium oxide utilized as a top layer. The intermediate layer is a combination of ruthenium and iridium. Hence, in the field of electrowinning, there has been utilized a complex, multi-layer approach, involving ruthenium and palladium in different layers, such as taught in U.S. Pat. No. , 4,157,943 to provide anodes having acceptable service life in electrowinning. Thus, it was not expected to achieve a desirable process for electrowinning as disclosed in the present invention with a more simplistic coating composition as described hereinbefore.

It has also been found that for the copper electrowinning process of the present invention, a coating of ruthenium oxide and rhodium oxide may be most serviceable. The coating composition solutions for this aspect of the invention are typically those consisting of $RuCl_3$, $RhCl_3$ and hydrochloric acid, all in alcohol solution. It will be understood that the $RuCl_3$ may be utilized in a form such as $RuCl_3 \cdot H_2O$ and $RhCl_3$ can be similarly utilized, such as $RhCl_3 \cdot H_2O$. For convenience, such forms will generally be referred to herein simply as $RuCl_3$ and $RhCl_3$. Aqueous based solutions may be employed. Usually, the ruthenium chloride can be dissolved along with the rhodium chloride in either isopropanol or butanol, all combined with small additions of hydrochloric acid, with butanol being preferred. Such coating composition will contain sufficient Rh constituent to provide at least about 0.5 mole percent up to about 50 mole percent rhodium metal, basis 100 mole percent of rhodium and ruthenium metals, with a preferred range being from about 1 mole percent up to about 20 mol percent rhodium. A composition containing rhodium in an amount less than 1 mole percent will be inadequate for providing an electrode coating having a low operating voltage and extended service life. On the other hand, greater than 50 mole percent rhodium will also be detrimental to a low operating voltage and extended service life. As will be understood from the foregoing, for best coating characteristics, the molar ratio of ruthenium to rhodium, as metals, in the resulting coating will advantageously be from greater than 50:50 up to about 99.5:0.5, and preferably from about 75:25 to about 95:5.

It was not expected that this coating for the present invention would provide extended lifetimes for copper electrowinning.

For electrowinning anodes, it has previously been taught, as discussed hereinabove, that there can be used a layer containing ruthenium oxide. But, as also mentioned above, the ruthenium oxide is combined with titanium oxide utilized as a top layer. Or, as discussed in the U.S. Pat. No. 3,878,083, for copper electrowinning, the ruthenium oxide may be combined with tantalum oxide or titanium oxide. However, as further discussed therein, these mixed oxide coatings did not prove satisfactory for commercial use. Thus, it was not expected to achieve a desirable process for electrowinning as disclosed in the present invention with the ruthenium oxide plus rhodium oxide coating composition as described hereinbefore.

The coating composition employed herein can be applied to the metal mesh member by any of those means, which are useful for applying a liquid coating composition to a metal substrate. Such methods of application include dip application, e.g., spin and dip drain techniques, brush application, roller coating and spray application such as electrostatic spray. Moreover, spray application and combination techniques, e.g., dip drain with spray application can be utilized. Advantageously, electrostatic spray application can be used for best wrap around affect of the spray for coating the backside of an article such as a mesh electrode. Such wrap around affect of the spray to the back face can occur, such as when coating is applied to a mesh member front face, and can be particularly desirable where the valve metal substrate member may serve on a lead base, as discussed hereinabove. Where such an application of the valve metal substrate is desired, the total weight of coating can be applied to a front face and a back face of the substrate in varying proportions, e.g., of from about 50:50 to about 80:20 of front to back faces, and more generally from 50:50 to 60:40 (front:back). When wrap around affect is experienced, application to a mesh front face only will usually provide at least a 90:10 ratio (front:back) for the coating.

Regardless of the method of application of the coating, conventionally, a coating procedure is repeated to provide a uniform, more elevated coating weight than achieved by just one coating. Usually, the number of coats for a representative coating layer of a type as mentioned hereinbefore for the present invention will not exceed about 30 coats, with the amount of coating applied to be sufficient to provide in the range of from about 1 $g/m^2$ (gram per square meter) to about 25 $g/m^2$, and be preferably, from about 5 $g/m^2$ to about 15 $g/m^2$ total of coating, e.g., the ruthenium plus palladium coating, when elements are calculated in the coating as present in metallic form. For convenience, such may be expressed as, for example, "from about 5 $g/m^2$ to about 15 $g/m^2$, as metals."

Following application of the coating, the applied composition will be heated to prepare the resulting mixed oxide coating by thermodecomposition of the precursors present in the coating composition. This prepares the mixed oxide coating containing the mixed oxides in the molar proportions, basis the metals of the oxides, as above discussed. Such heating for the thermal decomposition will be conducted at a temperature of at least about 350° C. for a time of at least about 2 minutes. More typically, the applied coating will be heated at a more elevated temperature of up to about 600° C. for a time of not more than about 15 minutes. Suitable conditions can include heating in air or oxygen. In general, the heating technique employed can be any of those that may be used for curing a coating on a metal substrate. Thus, oven coating, including conveyor ovens may be utilized. Moreover, infrared cure techniques can be useful. Following such heating, and before additional coating as where an additional application of the coating composition will be applied, the heated and coated substrate will usually be permitted to cool to at least substantially ambient temperature. Particularly after all applications of the coating composition are completed, postbaking can be employed. Typical postbake conditions for coatings can include temperatures of from about 450° C. up to about 600° C. Baking times may vary from about 15 minutes, up to as long as four hours.

It will be understood that alternatives to the conventional meshes that are expanded metal meshes may be utilized herein as the mesh member, and still be serviceable. Thus, the term "mesh" is not to be limited simply to expanded metal mesh. Other mesh member forms include those made from thin, generally flat members in strip form, which may also be called ribbon form, that might be utilized as a grid. Also, the mesh member may be prepared in wire form, e.g., a woven wire mesh that might be an open mesh sheet in the form of a screen. The wire form mesh might be formed from individual wires individually applied onto a base as in a cross-hatch pattern. A suitable mesh member may also be a perforate member such as prepared from a punched and/or drilled plate.

It has been found that in the copper electrowinning process of the present invention that for a most desirable cell voltage savings as well as extended operating lifetime that the cell operate at an applied current density of below about 1 kiloamp per square meter of anode surface. Preferably, for best voltage savings and extending lifetime, copper electrowinning will be conducted wherein there is an impressed electric current on the anode that provides an applied current density of below 0.5 kiloamp per square meter ($kA/m^2$).

A top coating layer, e.g., of a valve metal oxide, or tin oxide, or mixtures thereof, is preferably avoided for preparing an anode for copper electrowinning. It is therefore most contemplated for use in other electrowinning processes. The top coating layer will typically be formed from a valve metal alchoxide in an alcohol solvent, with or without the presence of an acid. Additionally, salts of dissolved metals may be utilized. Where titanium oxide will be utilized, it is contemplated that such substituent may be used with doping agents.

Where tin oxide is the desired top coating layer, suitable precursor substituents can include $SnCl_4$, $SnSO_4$, or other inorganic tin salts. The tin oxide may be used with doping agents. For example an antimony salt may be used to provide an antimony doping agent. Other doping agents include ruthenium, iridium, platinum, rhodium and palladium, as well as mixtures of any of the doping agents.

Where a top coating layer is utilized, following application of such top coating, it may be desirable to postbake the coating layers, e.g., in a manner as discussed hereabove.

As has been discussed hereinbefore, the compound electrode is utilized as an anode in a copper electrowinning cell. However, it is also contemplated that these electrolytic cells may find use in other electrowinning or like processes, such as electrowinning of zinc, cadmium, chromium, nickel, cobalt, manganese, silver, lead, gold, platinum, palladium, tin, aluminum, and iron. Such a like process might also include copper foil production. The substrate may be a moving substrate and the electrodeposition in such process can include electrogalvanizing or electrotinning.

While the electrocatalytic coating in electrowinning processes other than copper electrowinning will virtually always be the ruthenium oxide and palladium oxide coating, or the rhodium oxide plus ruthenium oxide coating, it is also contemplated that for such other electrowinning processes it might be, for example, platinum group metals other than palladium may be utilized. Such coating might include platinum and ruthenium or rhodium, e.g., ruthenium oxide with platinum oxide. Additionally, it is contemplated that additional, similar coating substituents may be used, particularly in these other electrowinning processes. However, the coating utilized herein is preferably completely free, and advantageously substantially free, of valve metal oxide. It may also be free of oxides such as iridium oxide. Such, however, may not be the case for any topcoating layer that may be contemplated.

A cell using the present invention can be a cell where a gap is maintained between electrodes, and cell electrolyte is contained within the gap. The electrolyte might typically be a sulfate-containing electrolyte such as sulfuric acid or copper sulfate in copper electrowinning. When utilizing the cell beyond a consideration of copper electrowinning, the electrolyte might include substituents such as magnesium sulfate and potassium sulfate, or zinc sulfate and sodium sulfate in zinc electrowinning. It is also contemplated that the electrolyte may be a chloride electrolyte and contain a metal chloride salt plus have a hydrochloric acid component. It is further contemplated that copper electrowinning cells using the process of the present invention will be unseparated cells, i.e., the cells will not be diaphragm or membrane cells.

The following examples show ways in which the invention has been practiced, as well as showing comparative examples. However, the examples showing ways in which the invention has been practiced should not be construed as limiting the invention.

EXAMPLE 1

A flat, expanded titanium mesh sample of unalloyed grade 1 titanium, measuring approximately 0.064 cm thick was annealed in a vacuum at 850° C. and then etched in a 90–95° C. solution of 18–20% hydrochloric acid for 1½ hours to achieve a roughened surface.

A coating composition consisting of ruthenium and palladium salts was prepared by dissolving 0.93 grams (g) ruthenium as $RuCl_3.H_2O$ and 0.33 g palladium as $PdCl_2 \bullet H_2O$ in 29.2 ml n-butanol with 0.8 milliliters (ml) concentrated HCl. The solution was allowed to stir until the salts were fully dissolved.

The sample mesh was coated by brush application to both sides of the mesh. The coating was applied in layers, with each coating being dried and then baked in air at 480° C. for 7 minutes, for a total of ten coating layers of ruthenium oxide and palladium oxide having a 75:25 mole ration of Ru:Pd as metal and the total coating weight being substantially evenly distributed between the front and back sides of the mesh.

The coated mesh was then attached by spot welding to each side of a ¼" thick lead—calcium alloy substrate, such alloy being used commercially in copper electrowinning. The mesh/lead anode was then operated in a laboratory, copper electrowinning pilot cell for 1304 hours at 0.3 $kA/m^2$. The electrolyte for the cell was a commercial copper electrowinning electrolyte primarily containing sulfuric acid and copper sulfate in an aqueous medium. This anode achieved an average voltage savings of 330 millivolts (mV) compared with the lead/calcium alloy anode without the mesh attachment operating for the same period of time.

EXAMPLE 2

A flat, expanded titanium mesh sample of unalloyed grade 1 titanium, measuring 10 centimeters (cm) wide by 15 cm long and 0.064 cm thick, and providing two 10×15 cm major faces, was etched in a 90–95° C. solution of 18–20% hydrochloric acid for 1½ hours for a resultant weight loss of 20–25 grams per square meter ($g/m^2$). The mesh was then cooled and rinsed in deionized water.

A coating composition was then prepared by dissolving 0.93 g ruthenium as $RuCl_3 \bullet H_2O$, 0.33 g palladium as $PdCl_2 \cdot H_2O$ in 29.2 milliliters (ml) of n-butanol with 0.8 ml concentrated HCl. The solution was allowed to stir until the salts were fully dissolved.

The sample mesh was coated by brush application to both sides of the mesh. The coating was applied in layers, each layer being dried at about 110° C. for three minutes and then baked at 480° C. for seven minutes. The coating weight achieved of ruthenium oxide and palladium oxide provided about 9.9 $g/m^2$ of Ru as metal, and having a 75:25 mole ratio of Ru:Pd as metal, with the total coating weight being distributed between the front and back sides.

Two samples measuring 2.5×3.2 cm for their major faces were cut from the coated mesh. A titanium rod was welded to each of the samples to serve as a current lead. Each sample was operated as an anode in an unseparated, glass test cell in an electrolyte that was 150 grams per liter of sulfuric acid. The test cell was maintained at 50° C. and operated at a current density of 10 kiloamps per square meter ($kA/m^2$), utilizing a zirconium cathode.

The test cell was operated until the cell voltage began to rise rapidly. Results indicated an extended lifetime, of 151 hours for the two samples, for an average lifetime in terms of hours per Ru loading, of 15.3 hours per gram per square meter ($hrs/g/m^2$).

COMPARATIVE EXAMPLE 2

Titanium mesh samples of unalloyed grade 1 titanium, were coated with an electrochemically active coating containing ruthenium oxide and titanium oxide (thus making this a comparative example). The coating was prepared by dissolving 1.26 g ruthenium as $RuCl_3$ and 12.7 ml titanium orthobutyltitanate in 32.1 ml n-butanol with 0.88 ml concentrated HCl. The coating had a 75:25 mole ratio of Ru:Ti as metal. The coating was applied to the mesh substrate in the manner of Example 2 to a coating weight of 4.1 $g/m^2$ Ru. The coated mesh was then tested as in Example 2. The samples exhibited a lifetime, in terms of hours per Ru loading, of 2.2 hours per gram per square meter ($hrs/g/m^2$).

EXAMPLE 3

A titanium mesh sample of unalloyed grade 1 titanium, was coated with an electrochemically active coating composition providing a coating containing ruthenium oxide and palladium oxide having a 85:15 mole ratio of Ru:Pd as metal. The coating composition, application and baking were all as described in Example 2. The coating weight was 11.3 $g/m^2$ of ruthenium as metal.

A sample prepared as an anode as described in Example 2 was used in a test cell. The test cell, as described in Example 1, was operated until the cell voltage began to rise rapidly. Results indicated an extended lifetime, in terms of hours per Ru loading, of 15.8 $hrs/g/m^2$.

COMPARATIVE EXAMPLE 3

A titanium mesh sample of unalloyed grade 1 titanium, was coated with an electrochemically active coating composition containing ruthenium oxide and tantalum oxide, thus making this a comparative example. The coating had a 65:35 mole ratio of Ru:Ta as metal and was prepared by dissolving 0.75 g ruthenium as $RuCl_3$ and 24.9 ml of a solution of $TaCl_5$ in isopropanol along with 0.4 ml of concentrated HCl and 4.7 ml n-butanol. The coating composition was applied and baked in the manner of Example 2 to the coating weight of 2.3 $g/m^2$.

A titanium mesh sample prepared as an anode as described in Example 2 was utilized in a test cell as described in Example 2. The test cell was operated until the cell voltage began to rise rapidly. Results indicated an extended lifetime, in terms of hours per Ru loading, of 0.4 $hrs/g/m^2$.

COMPARATIVE EXAMPLE 4

A titanium mesh sample of unalloyed grade 1 titanium, was coated with an electrochemically active coating composition providing a coating containing ruthenium oxide and palladium oxide. The coating had a 25:75 mole ratio of Ru:Pd as metal. The low mole ratio of Ru:Pd thus made this a comparative example. The coating was prepared by dissolving 0.30 g ruthenium as $RuCl_3$ and 0.96 g Pd as $PdCl_2$ in 29.2 ml of n-butanol and 0.8 ml concentrated HCl. The coating was applied and baked in the manner of Example 2 to the coating weight of 6.7 g/m$^2$.

A titanium mesh sample prepared as an anode as described in Example 2 was utilized in a test cell as described in Example 2. The test cell was operated until the cell voltage began to rise rapidly. Results indicated a lifetime, in terms of hours per Ru loading, of 6.6 hrs/g/m$^2$.

COMPARATIVE EXAMPLE 5

A titanium mesh sample of unalloyed grade 1 titanium, was coated with an electrochemically active coating composition providing a coating containing ruthenium oxide and prepared by dissolving 1.26 g ruthenium as $RuCl_3$ in 29.2 ml n-butanol with 0.8 ml concentrated HCl. The coating composition was applied and baked in the manner of Example 2 to the coating weight of 12 g/m$^2$. The lack of palladium in the coating makes this a comparative example.

A titanium mesh sample prepared as an anode as described in Example 2 was utilized in a test cell as described in Example 1. A test cell was operated until the cell voltage began to rise rapidly. Results indicated a lifetime of 0.6 hrs/g/m$^2$.

EXAMPLE 6

A flat, expanded titanium mesh sample of unalloyed grade 1 titanium, measuring approximately 0.064 cm thick was annealed in a vacuum at 850° C. and then etched in a 90–95° C. solution of 18–20% hydrochloric acid for 1½ hours to achieve a roughened surface.

A coating composition consisting of ruthenium and rhodium salts was prepared by dissolving 1.13 g ruthenium as $RuCl_3.H_2O$ and 0.128 g rhodium as $RhCl_2 \bullet H_2O$ in 29.6 ml n-butanol with 0.4 ml concentrated HCl. The solution was allowed to stir until the salts were fully dissolved.

The sample mesh was coated by brush application to both sides of the mesh. The coating was applied in layers, each layer being dried at about 110° C. for three minutes and then baked at 480° C. for seven minutes. The coating weight achieved of ruthenium oxide and rhodium oxide provided about 13.2 g/m$^2$ of Ru as metal, and having a 90:10 mole ratio of Ru:Rh as metal, with the total coating weight being distributed between the front and back sides.

Two samples measuring 7.5 cm$^2$ square their major faces were cut from the coated mesh. A titanium rod was welded to each of the samples to serve as a current lead. Each sample was operated as an anode in an unseparated, glass test cell in an electrolyte that was 150 grams per liter of sulfuric acid. The test cell was maintained at 50° C. and operated at a current density of 10 kiloamps per square meter (kA/m$^2$), utilizing a zirconium cathode.

The test cell was operated until the cell voltage began to rise rapidly. Results indicated an average lifetime in terms of hours per Ru loading, of 15.9 hours per gram per square meter (hrs/g/m$^2$).

While in accordance with the patent statutes the best mode and preferred embodiment have been set forth, the scope of the invention is not limited thereto, but rather by the scope of the attached claims.

What is claimed is:

1. An electrode for use in a low current density, oxygen evolving application with a sulfate electrolyte, said electrode comprising:

(a) a solid electrode base;

(b) a valve metal surface member combined with said lead base in electrically conductive contact; and (c) a coating layer of an electrochemically active coating on said valve metal surface member, said coating comprising a mixture of platinum group metal oxides consisting essentially of ruthenium oxide and palladium oxide or ruthenium oxide and rhodium oxide, wherein said ruthenium oxide and palladium oxide or ruthenium oxide and rhodium oxide are present in a molar proportion of from about 50:50 to about 99:1 of ruthenium to palladium or ruthenium to rhodium, as metals.

2. The electrode of claim 1, wherein said coating is iridium free and said ruthenium oxide and palladium oxide or said ruthenium oxide and rhodium oxide are present in a molar proportion of from about 75:25 to about 95:5 of ruthenium to palladium or ruthenium to rhodium, as metals, and said coating is applied to said valve metal surface member in an amount to provide a coating of said ruthenium oxide and palladium oxide having a loading of from about 1 g/m$^2$ to about 25 g/m$^2$ of ruthenium and palladium or ruthenium and rhodium, as metals.

3. The electrode of claim 2, wherein said coating composition is applied to said front face and said back face of said substrate member in a proportion of from about 50:50 to about 80:20 of front to back faces.

4. The electrode of claim 1, wherein said electrochemically active coating is applied on one or more of a front face and on a back face of said substrate.

5. The electrode of claim 1, wherein said valve metal surface is a valve metal mesh, sheet, blade, tube, punched plate or wire member.

6. The electrode of claim 5, wherein said valve metal is selected from the group consisting of titanium, tantalum, aluminum, molybdenum, zirconium, niobium, tungsten, their alloys and intermetallic mixtures.

7. The electrode of claim 1, wherein said sulfate containing electrolyte contains one or more of sulfuric acid, copper sulfate, zinc sulfate, and sodium sulfate.

8. The electrode of claim 1, wherein a surface of said valve metal surface member is a roughened surface prepared by one or more steps of intergranular etching, grit blasting, or thermal spraying.

9. The electrode of claim 8, wherein there is established a ceramic oxide barrier layer as a pretreatment layer on said roughened surface.

10. The electrode of claim 1, wherein there is established on said electrocatalytic coating at least one top coating layer containing a valve metal oxide coating or a tin oxide coating, or mixtures thereof.

11. The electrode of claim 10, wherein said top coating layer of valve metal oxide comprises an oxide selected from the group consisting of titanium, tantalum, niobium, zirconium, molybdenum, aluminum, hafnium, or tungsten.

12. The electrode of claim 10, wherein said top coating layer is a tin oxide coating layer doped with one or more of Sb, F, Cl, Mo, W, Ta, Ru, Ir, Pt, Rh, Pd, or In and oxides thereof, and said doping agent is in an amount in the range of from about 0.1% to about 20%.

13. An electrolytic cell for the electrowinning of a metal selected from the group consisting of copper, cobalt, nickel, zinc, manganese, silver, lead, gold, platinum, palladium, tin, aluminum, chromium and iron containing the electrode of claim 1.

14. A multilayered electrode for use in an electrochemical cell, the multilayered electrode comprising a substrate member of lead or lead alloy and a valve metal member combined with said lead electrode base, which lead base is in sheet form and has a large broad surface, and which valve metal member is in electrically conductive contact with the lead base, which valve metal member is in mesh form and has a front, coated major face and a back major face, with said back major face of the valve metal member facing said lead base, said front coated major face having at least one coating layer of an electrochemically active coating comprising a mixture of platinum group metal oxides consisting essentially of ruthenium oxide and palladium oxide, wherein said ruthenium oxide and palladium oxide are present in a molar proportion of from about 50:50 to about 99:1 of ruthenium to palladium, as metals, and wherein said valve metal member is combined with said lead base in electrical contact, while said valve metal member at said broad surface projects a coated face from said lead base and presents an active surface in mesh form for said multilayered electrode.

15. The electrode of claim 14, wherein said ruthenium oxide and palladium oxide are present in a molar proportion of from about 75:25 to about 95:5 of ruthenium to palladium, as metals.

16. The electrode of claim 14, wherein said electrochemically active coating is applied to said valve metal member in an amount to provide a coating of said ruthenium oxide plus palladium oxide having a loading of from about 1 $g/m^2$ to about 25 $g/m^2$ of ruthenium plus palladium, as metals.

17. The electrode of claim 14, wherein said electrochemically active coating is applied on said front face and said back face of said valve metal member in a proportion of from about 50:50 to about 80:20 of front and back faces.

18. A method of producing an electrode for use in a low current density, oxygen evolving electrolytic cell, said method comprising the steps of:

establishing a valve metal substrate;

preparing a surface of said valve metal substrate;

providing at least one coating layer of an electrochemically active coating comprising a mixture of platinum group metal oxides consisting essentially of ruthenium oxide and palladium oxide, wherein said ruthenium oxide and palladium oxide are present in a molar proportion of from about 50:50 to about 99:1 of ruthenium to palladium, as metals; and heating said electrochemically active coating.

19. The method of claim 18, wherein said valve metal substrate is a valve metal mesh, sheet, blade, tube, punched plate or wire member.

20. The method of claim 18, wherein said valve metal substrate is a valve metal selected from the group consisting of titanium, tantalum, aluminum, molybdenum, zirconium, niobium, tungsten, their alloys and intermetallic mixtures.

21. The method of claim 18, wherein a surface of said valve metal substrate is prepared as by one or more of etching, grit blasting or thermal spraying.

22. The method of claim 18, further comprising the step of establishing on said active coating layer of platinum group metal oxides a top coating layer containing a valve metal oxide selected from the group consisting of titanium, tantalum, niobium, zirconium, molybdenum, aluminum, hafnium or tungsten oxides.

23. The method of claim 18, wherein said ruthenium oxide and palladium oxide are present in a molar proportion of fro about 75:25 to about 95:5 of ruthenium to palladium, as metals.

24. The method of claim 18, wherein said electrochemically active coating is applied to said valve metal substrate in an amount to provide a coating of said ruthenium oxide plus palladium oxide having a loading of from about 1 $g/m^2$ to about 25 $g/m^2$, of ruthenium plus palladium, as metals.

25. The method of claim 18, wherein said heating is by baking said electrochemically active layer at a temperature of from about 350° C. to about 600° C. for a time of from about 2 minutes up to about 15 minutes per applied layer of coating, and said cell is an electrolytic cell for electrowinning of a metal.

* * * * *

UNITED STATES PATENT AND TRADEMARK OFFICE

CERTIFICATE OF CORRECTION

PATENT NO. : 6,802,948 B2 
DATED : October 12, 2004
INVENTOR(S) : Kenneth L. Hardee, Lynne M. Ernes and Carl W. Brown, Jr.

It is certified that error appears in the above-identified patent and that said Letters Patent is hereby corrected as shown below:

Title page,
Item [57], ABSTRACT,
Line 1, delete "cooper' and replace with -- copper --.

Signed and Sealed this

Twenty-sixth Day of April, 2005

JON W. DUDAS
*Director of the United States Patent and Trademark Office*